US011485573B1

(12) United States Patent
Melancon, Jr.

(10) Patent No.: US 11,485,573 B1
(45) Date of Patent: Nov. 1, 2022

(54) CONTAINER WITH AT LEAST ONE RAMP WALL

(71) Applicant: Ramp Container LLC, Lynchburg, VA (US)

(72) Inventor: Dennis Wayne Melancon, Jr., Lynchburg, VA (US)

( * ) Notice: Subject to any disclaimer, the term of this patent is extended or adjusted under 35 U.S.C. 154(b) by 0 days.

(21) Appl. No.: 17/479,405

(22) Filed: Sep. 20, 2021

(51) Int. Cl.
*B65D 88/54* (2006.01)
*B65D 90/00* (2006.01)

(52) U.S. Cl.
CPC ..... *B65D 88/542* (2013.01); *B65D 90/0086* (2013.01)

(58) Field of Classification Search
CPC .. B65D 88/542; B65D 90/0086; B65D 90/00; B65D 90/06; B65D 88/124; B65D 88/125
USPC ..... 220/1.5; 206/600
See application file for complete search history.

(56) References Cited

U.S. PATENT DOCUMENTS 5,624,049 A * 4/1997 Kovash ..... B65D 88/128 220/650
9,067,524 B2 * 6/2015 Melancon, Jr. ..... B60P 1/6463
9,725,895 B1 * 8/2017 Gill ..... E04B 1/34331
9,884,575 B2 2/2018 Melancon
10,252,855 B1 * 4/2019 Melancon, Jr. ..... B65D 88/542
2009/0159592 A1 * 6/2009 Vitalis ..... B65D 88/125 220/796
2012/0037198 A1 * 2/2012 Cantin ..... E04B 1/3442 220/1.5
2013/0062025 A1 * 3/2013 Bromberek ..... B65D 90/18 160/242
2017/0341559 A1 * 11/2017 Melancon, Jr. ..... B65D 90/18
2019/0270365 A1 * 9/2019 Royer ..... E05F 11/34
2021/0188062 A1 * 6/2021 Boutin ..... B60P 7/04

* cited by examiner

*Primary Examiner* — Rafael A Ortiz
(74) *Attorney, Agent, or Firm* — Laubscher & Laubscher P.C.

(57) ABSTRACT

A container for storing and transporting material includes a container body having a bottom wall and a pair of parallel spaced side walls connected with opposite edges of the bottom wall to define a chamber having first and second open ends. A pair of ramp walls are connected with the container body adjacent the first and second open ends, respectively. Each ramp wall includes at least one pivot assembly, which provides pivotal movement of the ramp wall between closed and open positions, respectively. Preferably, the pivot assembly includes at least one pivot shaft extending through one end of the ramp wall and at least one counterbalancing helical torsion spring cooperating with the pivot shaft to bias the ramp wall during movement between closed and open positions.

15 Claims, 7 Drawing Sheets

CONTAINER WITH AT LEAST ONE RAMP WALL

BACKGROUND OF THE DISCLOSURE

The present invention relates generally to industrial containers, and more specifically to containers for transporting and shipping material.

Industrial containers are used for a range of purposes, including hauling trash, work materials, machines, or any other material with a mass that requires a load bearing, rigid structure. The materials that are typically placed in these containers can be heavy and difficult to manage, oftentimes requiring the use of heavy-duty equipment to load and unload them. The loading equipment may include things such as a backhoe, crane, truck, or other similar device. When these devices haul, load and unload materials, it is beneficial for the container to have an open upper end and an opening at one end of the container, both to allow for easier loading and unloading of materials. Such openings at an end of containers are typically provided by one or two doors that swing open. Another assembly is with a ramp wall, which provides a load-bearing structure to support the weight of a backhoe, truck or similar device.

Applicant owns a number of patents relating to containers with a ramp wall. The Melancon U.S. Pat. No. 9,067,524 discloses a container with a ramp wall that can be pivotably displaced between a closed position and a loading position by way of a hydraulic motor. The Melancon U.S. Pat. No. 9,884,575 patent discloses a similar ramp wall, but in place of a hydraulic motor at least one helical counterbalancing torsion spring is used to bias the ramp wall, allowing an individual to move the ramp wall between its open and closed position with minimal effort. The Melancon U.S. Pat. No. 10,252,855 discloses a ramp wall that is pivotable about a horizontal and vertical axis. The above-noted '524, '575 and '855 patents are incorporated herein by reference in their entirety.

Despite the benefits of containers having a ramp wall, there is a need to improve upon the above-noted known containers to further improve the ease with which material can be loaded into a container and secured during transport of the container.

SUMMARY OF THE DISCLOSURE

Accordingly, it is an object of the present disclosure to provide a container for storing and transporting material. The container includes a container body having a bottom wall and a pair of parallel spaced side walls connected with opposite edges of the bottom wall to define a chamber having first and second open ends. A pair of ramp walls are connected with the container body adjacent the first and second open ends, respectively. Each ramp wall includes at least one pivot assembly connected therewith, which provides pivotal movement of each ramp wall between closed and open positions, respectively. Preferably, the pivot assembly include at least one pivot shaft extending through one end of the ramp wall and at least one counterbalancing helical torsion spring cooperating with the pivot shaft to bias the ramp wall during movement between closed and open positions. The torsion spring has a torque force that corresponds with a gravitational torque force generated by the weight of the ramp walls, thus allowing for manual movement of the ramp walls by an individual.

In one embodiment, the pivot shaft extends through a lower end of a ramp wall and is connected with the container body bottom wall for pivotal movement about a horizontal axis.

In another embodiment, the container further includes a second pivot assembly connected with at least one ramp wall and configured to provide pivotal movement about a vertical axis. For this embodiment, the ramp wall pivot assemblies are adapted for removable connection with the container body such that when the first pivot assembly is connected with the container body, the second pivot assembly is disconnected to allow pivotal movement of the ramp wall about the horizontal axis. Similarly, when the second pivot assembly is connected with the container body, the first pivot assembly is disconnected to allow pivotal movement about the vertical axis. Preferably, the second pivot assembly includes a knuckle and pin assembly arranged on a side edge of the first ramp wall.

In yet another embodiment, the container further includes a top wall connected with the side walls. The top wall preferably includes a plurality of support bars connected with the side walls and a flexible sheet arranged on the support bars and connected with the container body to cover the upper end of the container. The support bars are arranged in spaced relation between the first and second open ends, and the flexible sheet has a length and width that corresponds with a length and width of the container body. Alternatively, the top wall is a rigid structure connected with the side walls.

In a further embodiment, each support bar of the top wall has an arcuate configuration, and the flexible sheet has opposing side edges containing longitudinal openings through which a pair of rods extend. At least one securing strap is connected with each rod at a first end and connected with the container side wall at a second end. For this embodiment, the container includes a pair of parallel spaced wheels connected with an outer surface of the container body bottom wall adjacent the first open end.

It is also an object of the present disclosure to provide a shipping container for storing and transporting material. The shipping container includes a container body having a bottom wall connected with a pair of corrugated parallel spaced side walls, a corrugated top wall connected with the side walls, and a rear wall connected with the container defining a chamber having at least one open end. There is also a ramp wall with a pivot assembly connected with the container. The pivot assembly provides pivotal movement of the ramp wall between closed and open positions. Preferably, the pivot assembly includes at least one pivot shaft and at least one counterbalancing torsion spring cooperating with the pivot shaft. The pivot shaft extends through one end of the ramp wall and is connected with the container body for pivotal movement about an axis.

In one embodiment, the rear wall includes a second ramp wall connected with the container body adjacent a second open end. There is a second pivot assembly connected with the second ramp wall to provide pivotal movement between closed and open positions.

In another embodiment, the container includes a second pivot assembly connected with at least one of the ramp walls to provide pivotal movement about a vertical axis. The first and second pivot assemblies are adapted for removable connection as previously described.

In yet another embodiment, the rear wall is connected with the bottom wall, the side walls, and the top wall.

BRIEF DESCRIPTION OF THE FIGURES

Other objects and advantages of the disclosure will become apparent from a study of the following specification when viewed in the light of the accompanying drawing, in which.

DETAILED DESCRIPTION

Figure 1:
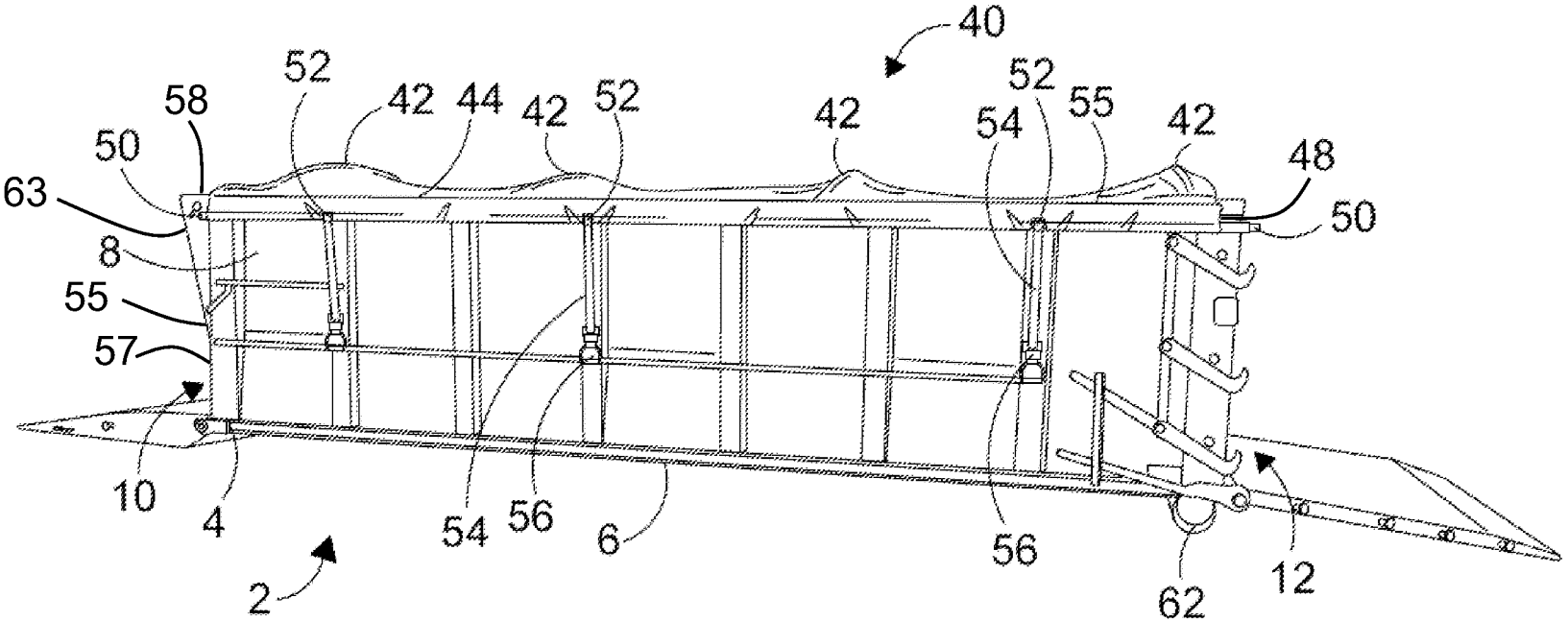
FIG. 1 is a side perspective view of a first embodiment of a container with ramp walls according to the present disclosure.
Figure 2:
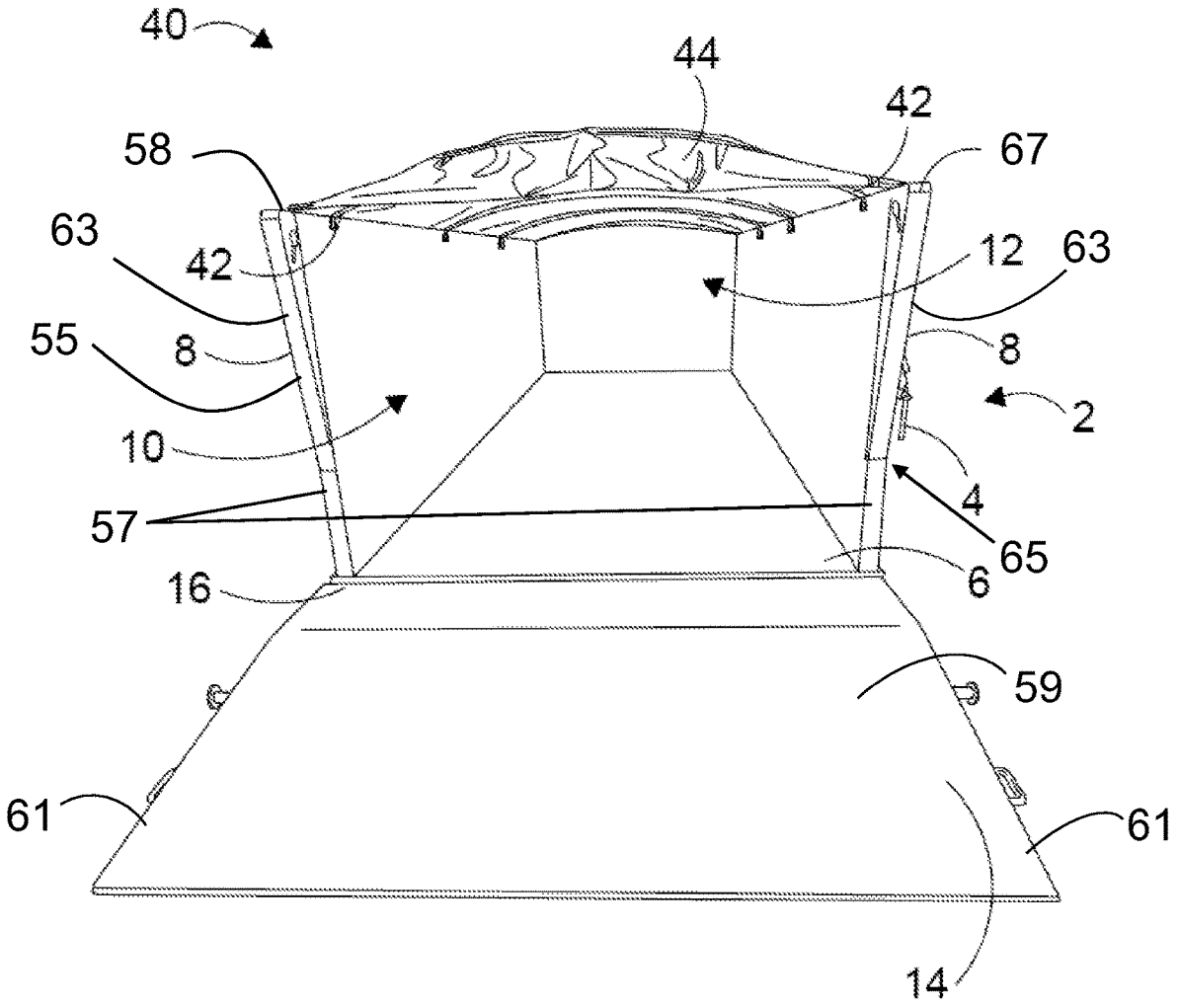
FIG. 2 is a front view of the container of FIG. 1.

The present disclosure relates to industrial containers with ramp walls. FIG. 1 shows a first embodiment of such a container 2 with two ramp walls at opposite ends of the container. As shown in FIG. 2, the container includes a container body 4 made of a rigid load-bearing structure. It has a bottom wall 6, a pair of parallel spaced side walls 8 connected with the bottom wall, and first 10 and second 12 open ends. A first ramp wall 14 is pivotally connected with the container bottom wall at a lower edge 16 of the ramp wall via a pivot assembly 18 which includes two horizontal pivot shafts 20 having helical counterbalancing torsion springs 22 arranged thereon. The torsion springs provide ease of movement of the ramp wall between its open position, shown in FIG. 2, and its closed position, shown in FIG. 3.

Referring again to FIG. 3, the torsion springs 22 have a first end 22*a* which contacts an outer surface of the ramp wall 14 and a second end 22*b* which contacts the container body 2 when the ramp wall is in its closed position. As the ramp wall 14 is lowered from its closed position toward the ground, as shown in FIG. 2, the torsion springs, which have a torque force that corresponds with a gravitational torque force of the ramp walls, provide a counterbalance to the weight of the ramp wall, making the wall easy for an individual to lower to its open position and lift to its closed position. When in its closed position, there are a pair of latches 24 that secure the ramp wall in place.

Figure 4:
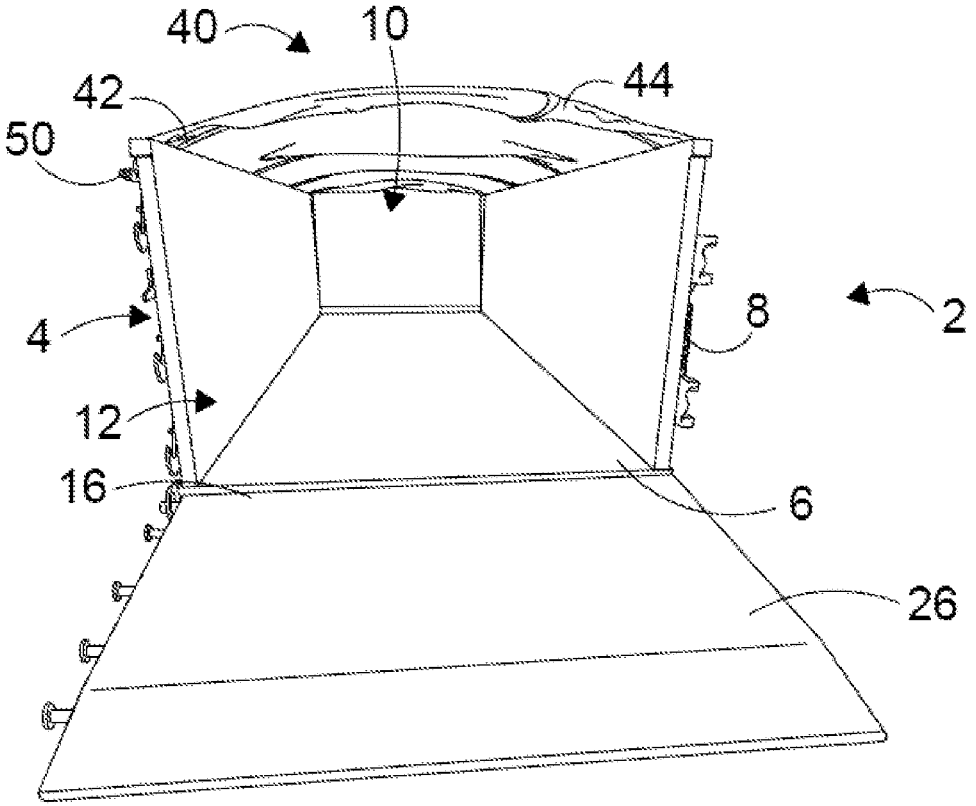
FIGS. 4 and 5 are rear views, respectively, of the container of FIG. 1.
Figure 5:
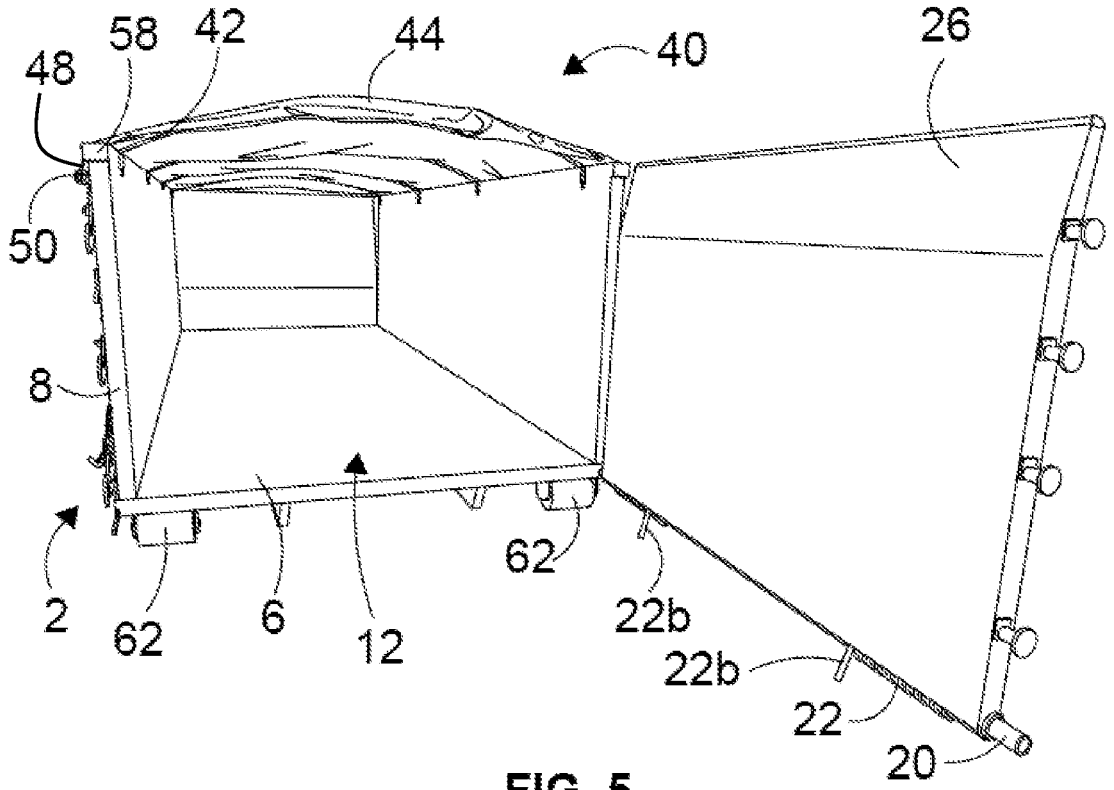
Figure 6:
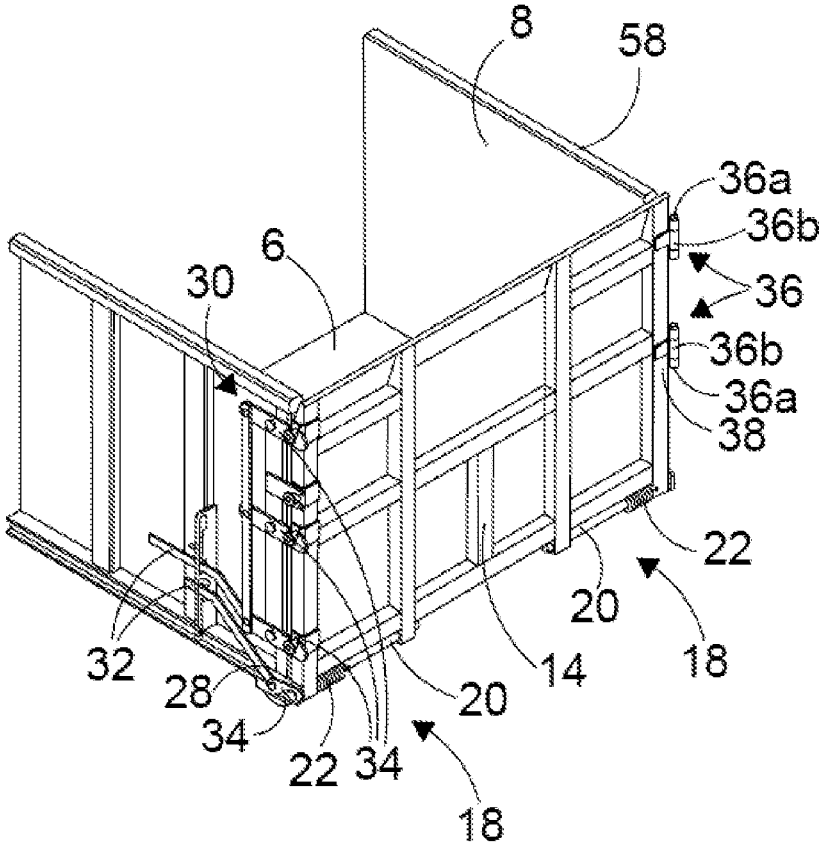
FIGS. 6 and 7 are partial top perspective views, respectively, of the ramp wall and container of FIGS. 4 and 5.
Figure 7:
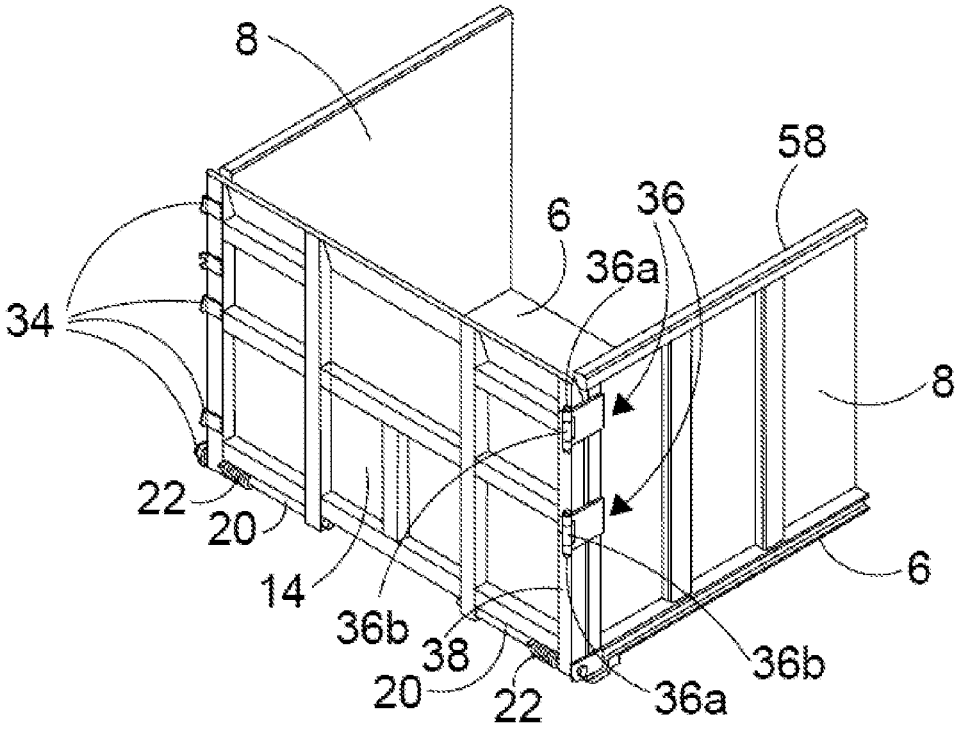

Referring now to FIGS. 4 and 5, a second ramp wall 26 is connected with the container bottom wall 6, but at the second end 12 of the container. As with the first ramp wall, the second wall is connected with the container body via a pivot assembly 18 with pivot shafts 20 which are configured to provide pivotal movement from an open, downward position to a closed, upward position. The pivot shafts also include helical counterbalancing torsion springs 22 with spring ends 22*a*, 22*b* as with the first ramp wall 14. FIGS. 6 and 7 show the second ramp wall in its closed position.

As shown in FIGS. 6 and 7, there are two locking assemblies arranged on a side wall 8 of the container. The first locking assembly 28 secures a pivot shaft 20 in place to allow for pivotal movement of the ramp wall about a horizontal axis. The second locking assembly 30 secures the ramp wall 26 to the container side wall 8 when the ramp wall is in its upright, closed position. Each of these locking assemblies include a lever 32 for operating latches 34 to secure the ramp wall in its place.

In addition to pivotal movement provided by the horizontal pivot shafts 20, the second ramp wall 26 includes a second pivot assembly 36 which provides swinging movement between open and closed positions. FIG. 5 shows the ramp wall in its open position after it is swung open. The assembly is a knuckle and pin assembly, which is shown more clearly in FIGS. 6 and 7. When the pin 36*a* of this assembly is inserted into the assembly knuckles 36*b*, the ramp wall side edge 38 is secured with the container body side wall 8. To allow for swinging movement, the locking assemblies 28, 30 arranged on the opposite side of the ramp wall, which secure the wall 26 against the container, can be operated to unlock the left side of the ramp wall and allow it to swing open. This is beneficial when the container needs to be accessed but heavy equipment will not be loaded or unloaded, or simply as an alternative assembly for accessing the container. To close the ramp wall, it is once again swung closed, and the locking assemblies 28, 30 are operated to secure the ramp wall against the container. The pins 36*a* can then be removed from the second assembly 36 and the ramp wall can be lowered and used as a ramp.

Referring again to FIG. 1, the container body 4 further includes a top wall cover 40 arranged on the container to secure contents that may be placed within the container and to ensure materials within the container are not exposed to elements that may damage them. The cover includes four arcuate support beams 42 extending between and connected with the side walls of the container 8, shown internally in FIG. 2. On the support beams, there is a flexible sheet 44 that covers the entire length and width of the upper end of the container. Preferably, the material of the flexible sheet has waterproof or water resistant qualities.

Side edges 46 of the flexible sheet 44 contain longitudinal openings 48 extending the length of the sheet through which a rod 50 extends. Spaced along the longitudinal openings there are three additional openings 52 which expose the rod. At each of these locations, a strap 54 is attached to the rod at one end and attached to the side of the container at another end. The straps include a ratcheting device 56 to tighten the flexible sheet against the upper edges 58 of the container side walls to secure all materials within the container body. One end of the container includes forward side edges 55 of the side walls 8 each having a first lower portion 57 arranged perpendicular to an upper edge 58 of the pair of parallel spaced side walls and a second upper angled portion 63 extending outwardly at a linear angle relative to the lower portion beginning at an interface 65 between the lower and upper portion and terminating at an interface 67 of the side edge 55 and top edge 58. The ramp wall 14 associated with this end of the container has a corresponding angled portion 59 such that when the ramp wall is pivoted to its upward closed position, the container side wall forward edges 55 are in continuous contact with sides 61 of the ramp wall.

Figure 3:
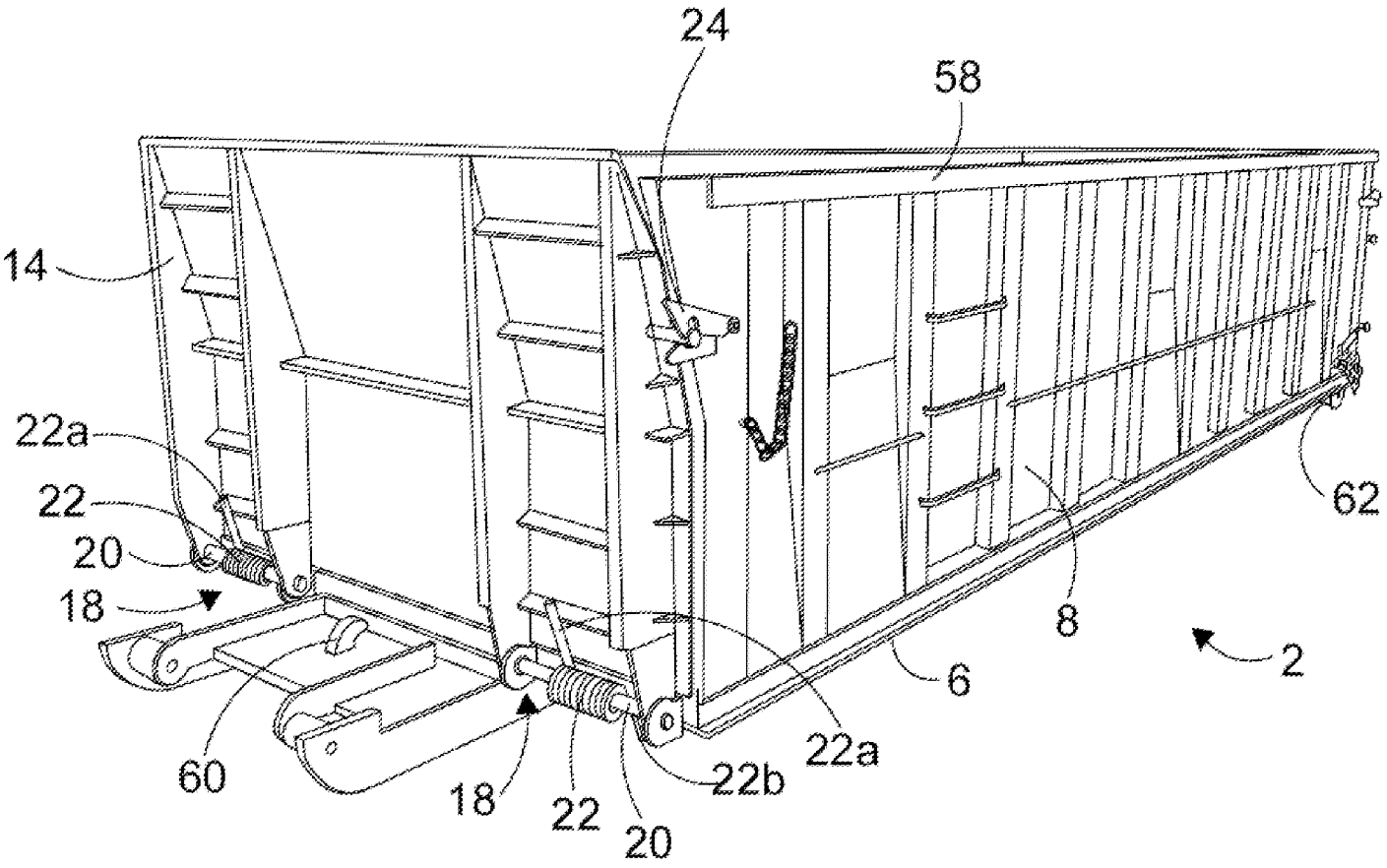
FIG. 3 is a front perspective view of the embodiment of FIG. 1.

Once the first 14 and second 26 ramp walls are in their upright, closed position, and the sheet 44 is attached to the container body 4, the container 2 is ready to be transported by a flatbed truck. As shown in FIG. 3, the container further includes a hook 60 at its first end and a pair of wheels 62 at its second end (also shown in FIGS. 1 and 5). The hook and wheels are used when loading the container onto a flatbed truck to transport the container to a new location.

Figure 8:
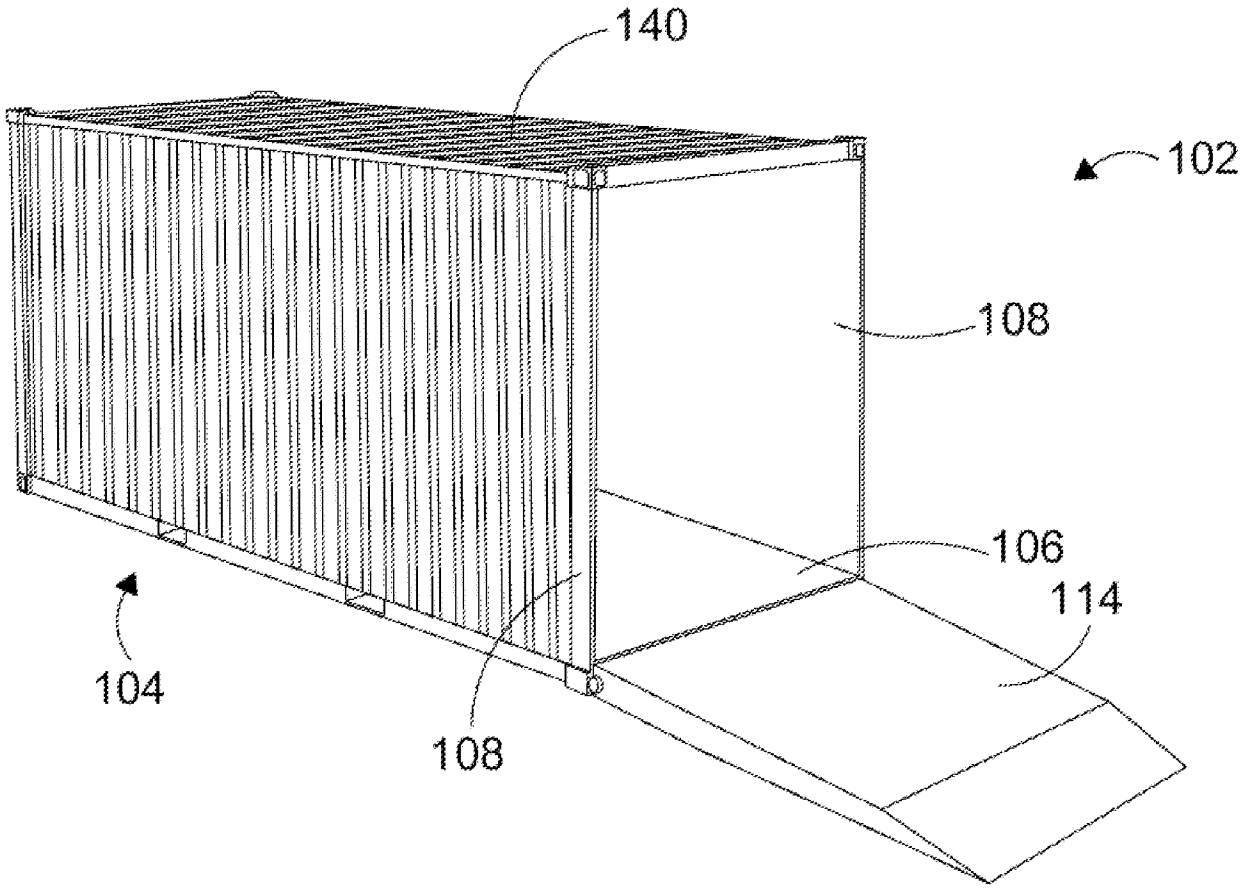
FIG. 8 is a front perspective view of a second embodiment of a container with a ramp wall according to the present disclosure.
Figure 9:
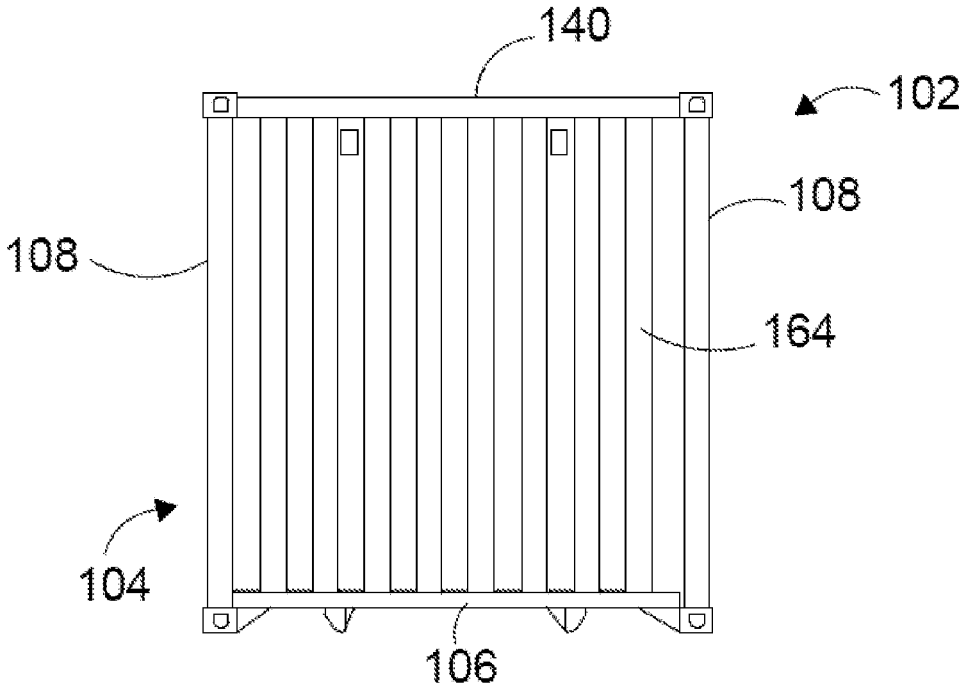
FIG. 9 is a rear view of the container of FIG. 8.

Referring now to FIGS. 8 and 9, there is shown a second embodiment of a container 102 with a ramp wall. The container in this instance is a shipping container, which includes a container body 104 having corrugated walls. There are parallel spaced side walls 108 connected with a top 140 and bottom wall 106, and a rear wall 164 which is connected with the top, bottom and side walls. These walls define a chamber which is enclosed by a ramp wall 114.

Figure 10:
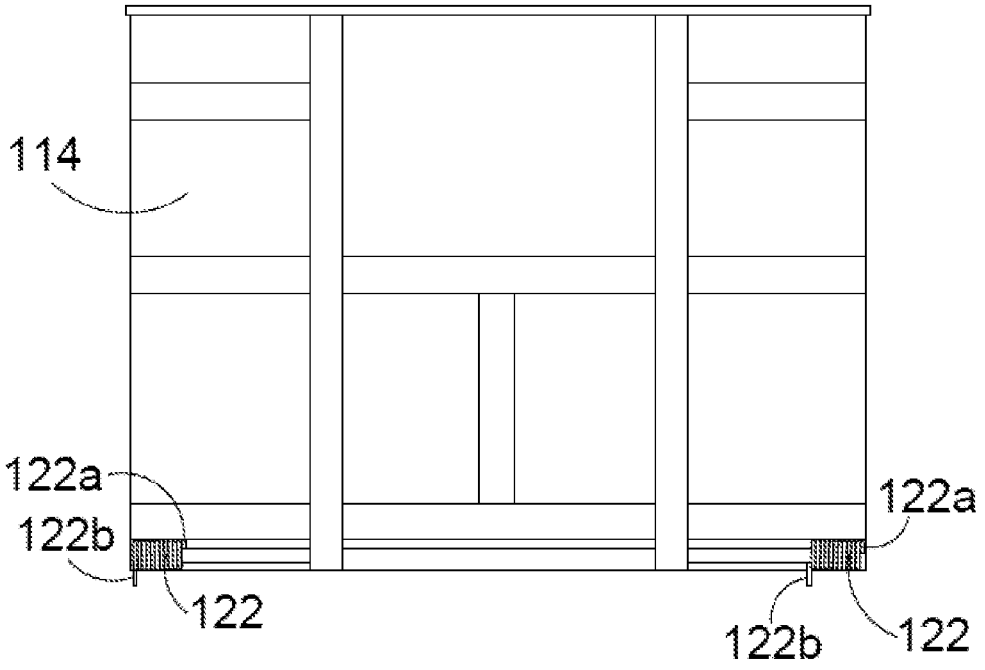
FIG. 10 is a front view of the container of FIG. 8.

As shown in FIG. 10, the ramp wall 114 includes a pivot assembly 118 with a horizontal pivot shaft 120 that extends across a lower section of the ramp wall. As with the previously described embodiment of FIGS. 1-7, the pivot shaft includes two helical counterbalancing torsion springs 122, each of which have two spring ends 122*a*, 122*b*, which allow for manual pivotal movement of the ramp wall between an upward closed position and downward open position. When the ramp wall is lowered to its open position (shown in FIG. 8) one spring end 122*a* contacts the outer surface of the ramp wall 114 and the other spring end 122*b* contacts the container body 104 to create tension and support the ramp wall as it is lowered.

In a separate embodiment (not shown), the rear wall is a second ramp wall as described above and shown in FIGS. 1-7. This ramp wall may include one or two pivot assemblies to allow for movement about a horizontal axis, a vertical axis or both.

The above described containers that include two ramp walls allows further access of the container over those known in the art. With two ramp walls, a vehicle can drive into the container through one end, unload heavy material, and exit the container through the other end. The container ramp walls are then pivoted to their upright, closed positions to secure the materials therein. If applicable, the container can be covered as described above. The container can then be loaded onto a flatbed truck and transported. If involving shipping containers, the container is transported to a shipping port, loaded on a ship by a crane, and transported by water to a new location.

Although the above description includes references to particular embodiments, it is to be understood that these embodiments are merely illustrative of the principles and applications of the present disclosure. It is therefore to be understood that numerous modifications may be made to the illustrative embodiments and that other arrangements may be devised and employed without departing from the spirit and scope of the present disclosure.

What is claimed is:

1. A container for storing and transporting material, comprising:

(a) a container body having a bottom wall, a pair of parallel spaced side walls connected with opposite edges of said bottom wall, and a top wall connected with said pair of parallel spaced side walls to define a chamber having first and second open ends, (b) a flexible sheet having a length and width corresponding with a length and width of said container body, respectively, and opposing side edges containing longitudinal openings extending therethrough configured to receive a rod and securement strap to connect said flexible sheet with said container body;

(c) a pair of rods extending through said side edge openings;

(d) at least one securement strap connected with said rods, said securement strap having a first end connected with said rod and a second end connected with an outer surface of one said side wall;

(e) a first ramp wall connected with said container body adjacent said first open end;

(f) a second ramp wall connected with said container body adjacent said second open end; and (g) at least one pivot assembly connected with said first and second ramp walls for pivotally connecting said first and second ramp walls with said container body, respectively, to provide pivotal movement of said ramp walls between closed and open positions, respectively.

2. The container for storing and transporting material as defined in claim 1, wherein said at least one pivot assembly includes:

(a) at least one pivot shaft extending through one end of said ramp wall and connected with said container body for pivotal movement about an axis; and (b) at least one counterbalancing helical torsion spring cooperating with said at least one pivot shaft, said torsion spring having a torque force corresponding with a gravitational torque force generated by the weight of each ramp wall to bias said ramp wall during movement between said closed and open positions.

3. The container for storing and transporting material as defined in claim 2, wherein said at least one pivot shaft extends through a lower end of said ramp wall and is connected with said container body for pivotal movement about a horizontal axis.

4. The container for storing and transporting material as defined in claim 3, and further comprising a second pivot assembly connected with at least one of said first and second ramp walls and configured to provide pivotal movement about a vertical axis, said ramp wall pivot assemblies adapted for removable connection with said container body, wherein when said first pivot assembly is connected with said container body bottom wall, said second pivot assembly is disconnected to allow pivotal movement of said ramp wall about said horizontal axis, and when said second pivot assembly is connected with said container body, said first pivot assembly is disconnected to allow pivotal movement about said vertical axis.

5. The container for storing and transporting material as defined in claim 4, wherein said second pivot assembly includes a knuckle and pin assembly arranged on a side edge of said first ramp wall.

6. The container for storing and transporting material as defined in claim 1, wherein said top wall further includes:

(a) a plurality of support bars connected with said side walls and arranged in spaced relation between said first and second open ends.

7. The container for storing and transporting material as defined in claim 6, wherein each of said support bars has an arcuate configuration.

8. The container for storing and transporting material as defined in claim 1, and further comprising a pair of parallel spaced wheels connected with an outer surface of said container body bottom wall adjacent said first open end.

9. A container for storing and transporting material, comprising:

(a) a container body having a bottom wall, a pair of parallel spaced side walls connected with opposite edges of said bottom wall, a top wall connected with said side walls, and a rear wall defining a chamber having at least one open end, a side edge of at least one of said pair of parallel spaced side walls adjacent said open end having a first lower portion arranged perpendicular to a top edge of said at least one of said pair of parallel spaced side walls and a second upper portion extending outwardly at a linear angle relative to said lower portion beginning at an interface between said first lower portion and said second upper portion and terminating at an interface between said side edge and said top edge; and (b) a ramp wall connected with said container body adjacent said at least one open end; and (c) at least one pivot assembly connected with said ramp wall for pivotally connecting said ramp wall with said container body, respectively, to provide pivotal movement of said ramp wall between closed and open positions, respectively.

10. The container for storing and transporting material as defined in claim 9, wherein said pivot assembly includes:

(a) at least one pivot shaft extending through one end of said ramp wall and connected with said container body for pivotal movement about an axis; and (b) at least one counterbalancing helical torsion spring cooperating with said at least one pivot shaft, said torsion spring having a torque force corresponding with a gravitational torque force generated by the weight of each ramp wall to bias said ramp wall during movement between said closed and open positions.

11. The container for storing and transporting material as defined in claim 10, wherein said at least one pivot shaft extends through a lower end of said ramp wall and is connected with said container body for pivotal movement about a horizontal axis.

12. The container for storing and transporting material as defined in claim 11, wherein said rear wall comprises a second ramp wall connected with said container body adjacent a second open end, said container further comprising a second pivot assembly connected with said second ramp wall.

13. The container for storing and transporting material as defined in claim 11, and further comprising a second pivot assembly connected with said ramp wall and configured to provide pivotal movement about a vertical axis, said first ramp wall pivot assemblies being adapted for removable connection with said container body, wherein when said one pivot assembly is connected with said container body, said second pivot assembly is disconnected to allow pivotal movement of said first ramp wall about said horizontal axis, and when said vertical axis pivot assembly is connected with said container body, said horizontal axis pivot assembly is disconnected to allow pivotal movement about said vertical axis.

14. The container for storing and transporting material as defined in claim 11, wherein said rear wall is connected with said bottom wall, said pair of parallel spaced side walls, and said top wall.

15. The container for storing and transporting material as defined in claim 9, wherein said ramp wall includes an angled upper portion corresponding with said at least one of said pair of parallel spaced side walls side edge second upper portion.

* * * * *